US009383106B2

(12) United States Patent
Cortes

(10) Patent No.: US 9,383,106 B2
(45) Date of Patent: Jul. 5, 2016

(54) TURBOMACHINE COMBUSTION CHAMBER HAVING A PERFORATED CHAMBER END WALL AND WITH NO DEFLECTOR

(75) Inventor: Thierry Cortes, Brunoy (FR)

(73) Assignee: SNECMA, Paris (FR)

( * ) Notice: Subject to any disclaimer, the term of this patent is extended or adjusted under 35 U.S.C. 154(b) by 744 days.

(21) Appl. No.: 13/636,873

(22) PCT Filed: Mar. 23, 2011

(86) PCT No.: PCT/FR2011/050622

§ 371 (c)(1),
(2), (4) Date: Sep. 24, 2012

(87) PCT Pub. No.: WO2011/117543

PCT Pub. Date: Sep. 29, 2011

(65) Prior Publication Data

US 2013/0008166 A1 Jan. 10, 2013

(30) Foreign Application Priority Data

Mar. 26, 2010 (FR) ..... 10 52244

(51) Int. Cl.
*F23R 3/10* (2006.01)
*F23R 3/04* (2006.01)
(Continued)

(52) U.S. Cl.
CPC . *F23R 3/10* (2013.01); *F23R 3/002* (2013.01); *F23R 3/04* (2013.01); *F23R 3/06* (2013.01); *F23R 3/12* (2013.01); *F23R 3/50* (2013.01); *F05D 2260/202* (2013.01); *F23R 2900/03041* (2013.01); *F23R 2900/03042* (2013.01)

(58) Field of Classification Search
CPC ..... F02C 7/12; F02C 7/18; F05D 2260/20; F05D 2260/202; F23R 3/04; F23R 3/06; F23R 3/10; F23R 3/12; F23R 2900/03041; F23R 2900/03042
See application file for complete search history.

(56) References Cited

U.S. PATENT DOCUMENTS 5,307,637 A 5/1994 Stickles et al.
5,590,531 A 1/1997 Desaulty et al.
(Continued)

FOREIGN PATENT DOCUMENTS

FR 2 285 503 7/1995
FR 2 856 467 12/2004

OTHER PUBLICATIONS

International Search Report Issued Aug. 1, 2011 in PCT/FR11/50622 Filed Mar. 23, 2011.

*Primary Examiner* — Gerald L Sung
*Assistant Examiner* — Scott Walthour
(74) *Attorney, Agent, or Firm* — Oblon, McClelland, Maier & Neustadt, L.L.P.

(57) ABSTRACT

An annular combustion chamber for a turbomachine, including an external wall and an internal wall which are oriented substantially axially relative to the rotation axis of the turbomachine, the combustion chamber being closed upstream by a chamber end wall oriented substantially radially, the chamber being supplied with compressed air coming from a compressor via a nozzle, the output direction of which is offset radially relative to the mid-axis of the combustion chamber, the chamber end wall including cooling air supply holes inclined to the direction normal to the chamber end wall. The number of holes oriented radially in the direction opposite to that where the outlet of the nozzle is located is greater than the number of holes oriented radially in the direction of the outlet of the nozzle.

11 Claims, 2 Drawing Sheets

(51) Int. Cl.

| | |
|---|---|
| ***F23R 3/12*** | (2006.01) |
| ***F23R 3/06*** | (2006.01) |
| ***F23R 3/00*** | (2006.01) |
| ***F23R 3/50*** | (2006.01) |

(56) References Cited

U.S. PATENT DOCUMENTS

2006/0042263 A1* 3/2006 Patel ..... F23R 3/06 60/776
2006/0042271 A1 3/2006 Morenko et al.
2007/0006588 A1 1/2007 Patel et al.
2007/0056289 A1* 3/2007 Sandelis et al. ..... 60/752
2007/0271925 A1* 11/2007 Alkabie ..... F23R 3/06 60/772
2008/0178599 A1* 7/2008 Hawie ..... F23R 3/10 60/752
2009/0293485 A1* 12/2009 Nolcheff et al. ..... 60/751
2011/0271678 A1 11/2011 Bourgois et al.

* cited by examiner

TURBOMACHINE COMBUSTION CHAMBER HAVING A PERFORATED CHAMBER END WALL AND WITH NO DEFLECTOR

BACKGROUND OF THE INVENTION

1. Field of the Invention

The field of the present invention is that of turbomachines and more particularly that of combustion chambers for these turbomachines.

2. Description of the Related Art

The combustion chamber of a gas turbine engine receives compressed air that comes from a high-pressure compressor arranged upstream, and delivers, downstream, a gas which has been heated up by the combustion of a fuel mixed with this compressed air. The chamber is generally of annular type and is housed inside an engine case, downstream of the diffuser the function of which is, by slowing down the stream of air, to convert the energy of the compression into a form that is compatible with the operation of the combustion engine and to orient the stream of compressed air leaving the compressor. It also comprises an inner wall and an outer wall between them delimiting a combustion zone. In its upstream part the chamber comprises a transverse chamber end wall in which openings are formed, each opening being equipped with a system for supplying carbureted air. Such a system is supplied with fuel from a liquid fuel injector and generally comprises concentric annular cascades which generate a swirling air stream encouraging the air to mix with the sheet of atomized fuel. The combustion chamber ends downstream in an opening which opens onto a turbine nozzle and, more generally, onto the turbine module of the turbomachine.

The air from the diffuser enters a zone surrounding the combustion chamber and some of it flows along the outer and inner walls thereof while the rest enters the combustion chamber and plays a part in burning the air-fuel mixture in a combustion zone. Schematically speaking, the combustion zone is split into two parts: a primary zone situated immediately downstream of the chamber end wall and in which the mixture is burnt, in near-stoichiometric proportions thanks to an inlet of air known as the primary air inlet, and a secondary part or dilution zone, situated further downstream, in which the gases are mixed with additional cooling air that enters via holes known as dilution holes.

In the prior art, protection, in the form of sectorized deflectors, lines the inside of the chamber end wall and has the role of protecting it from the intense radiation produced in the primary combustion zone. Air is therefore introduced via orifices made in the chamber end wall behind deflectors in order to cool them. This air flows along the rear face of the deflectors and is then guided to form a film along the interior face of the outer and inner walls of the chamber.

These deflectors are subjected to very high temperatures and, in order not to become burnt during use, they need a large quantity of cooling air, and this detracts from the efficiency of the chamber. It would therefore be desirable to dispense with the deflector, and this would also have significant concomitant advantages: because of the mass of metal it constitutes, the cooling-air consumption is greater than the amount that would be needed for cooling the chamber end wall alone. There would therefore be an advantageous saving on flow rate into the bargain.

To this end, solutions have been conceived of for cooling the chamber end wall without fitting a deflector. One solution that has been put forward is to cool the chamber end wall using multiple perforations and to orient the air stream that passes through these perforations so that it sweeps over the inside of the chamber end wall. This solution is notably described in Patent Application FR 2 856 467 filed in the name of the applicant company. It proposes making cylindrical perforations in the chamber end wall and inclining these perforations by orienting them in such a way that the air streams are increasingly steeply inclined nearer the axis of the chamber. The inclinations described are between 5 and 60°.

While this solution is well suited to an engine in which the compressor is of the axial type, i.e. an engine the diffuser of which is positioned along the axis of the injectors of the combustion chamber, it is not optimal for a turbomachine that has a centrifugal compressor. This is because these engines, which are usually small in size, have the diffuser situated at the periphery of the zone surrounding the combustion chamber and the outlet air is oriented axially, on the outer side of the combustion chamber. There is a risk that the outer wall will therefore be adequately cooled but, on the other hand, that an inner wall will be insufficiently cooled and could become burnt. An increase in the cooling flow rate to counter this phenomenon would impair the efficiency of the chamber and be accompanied by the production of unburnt species such as carbon monoxide CO.

Moreover, this solution has the disadvantage of greater difficulty in defining the cooling circuit during the engine design phase. This is because it is necessary to wait for the detailed engine design phase, with an engine cycle that is already stabilized, before a meaningful characterization of the aerodynamics of the airflow leaving the diffuser becomes available so that the definitive drilling pattern can be optimized. Demanding computation methods have therefore to be used in order to obtain the definitive solution.

BRIEF SUMMARY OF THE INVENTION

It is an object of the present invention to overcome these disadvantages by proposing a device for cooling the chamber end wall of a combustion chamber of a turbomachine with a centrifugal compressor which does not have at least some of the disadvantages of the prior art and, in particular, which does not require a deflector and which ensures a relatively uniform temperature for both the inner and outer walls of this chamber, without increasing the need for cooling air.

To this end, one subject of the invention is an annular combustion chamber for a turbomachine comprising an outer wall and an inner wall which are oriented substantially axially with respect to the axis of rotation of the turbomachine and which is closed at the upstream end by a chamber end wall oriented substantially radially, said chamber being supplied with compressed air from a compressor by a diffuser the outlet direction of which is radially offset from the median axis of the combustion chamber, said chamber end wall comprising cooling-air supply perforations which are inclined with respect to the direction normal to said chamber end wall. It is characterized in that the number of perforations the radial orientation of which is directed in the direction away from the outlet from said diffuser is greater than the number of perforations the radial orientation of which is directed toward the outlet of said diffuser.

The better air supply to the part directed away from the diffuser outlet part, on account of the greater number of holes oriented in that direction, makes it possible to compensate for the lower air flow rate that it receives as a result of the positioning of the diffuser. It is thus possible to cool the chamber end wall sufficiently that the fitting of a deflector to protect it from thermal radiation can be dispensed with.

For preference, all the perforations are oriented radially in the direction away from the outlet of said diffuser. This configuration corresponds to the optimal cooling of the part of the chamber end wall situated away from the outlet of the diffuser.

Advantageously, the perforations are inclined by an angle greater than 60° with respect to the direction normal to the chamber end wall in at least part of said chamber end wall. The very steep angle of inclination given to the perforations makes it possible to avoid this air interfering with the air intended for combustion in the primary zone or disrupting the setting of the richness in terms of the combustion of the fuel.

In one embodiment, said part of the chamber end wall is situated radially on the same side as the outlet of the diffuser. The cooling air which comes from the side on which the diffuser is situated has to travel a longer path than the air from the other perforations and it is desirable that, on exiting, it adheres as closely as possible to the chamber end wall.

In one particular embodiment, the perforations have the same cross section and the density of said perforations decreases radially from the side at which the outlet of the diffuser is situated to their median row.

In another embodiment, the perforations have the same cross section and the density of said perforations increases radially from their median row to the side away from the outlet of the diffuser.

These embodiments make it possible to take into consideration the fact that the air leaving the injection systems plays a part in cooling the median zone of the chamber end wall and that it is possible to reduce the cooling air flow rate from the perforations accordingly.

Advantageously, the chamber end wall is exposed directly to the thermal radiation of the primary combustion zone. There is therefore no longer any need for a deflector, because of the effective cooling provided by the suitable orientation of the perforations.

In one particular embodiment, the perforations are predominantly situated on the inner part of its chamber end wall. This configuration corresponds to use of the invention in the case of turbomachines with a centrifugal compressor and with a diffuser situated on the outer side of said combustion chamber.

The invention also claims a turbomachine equipped with a combustion chamber as described hereinabove.

BRIEF DESCRIPTION OF THE SEVERAL VIEWS OF THE DRAWINGS

The invention will be better understood, and other objects, details, features and advantages thereof will become more clearly apparent, during the following detailed explanatory description of one embodiment of the invention which is given purely by way of illustrative and nonlimiting example with reference to the attached schematic drawings.

In these drawings.

DETAILED DESCRIPTION OF THE INVENTION

Figure 1:
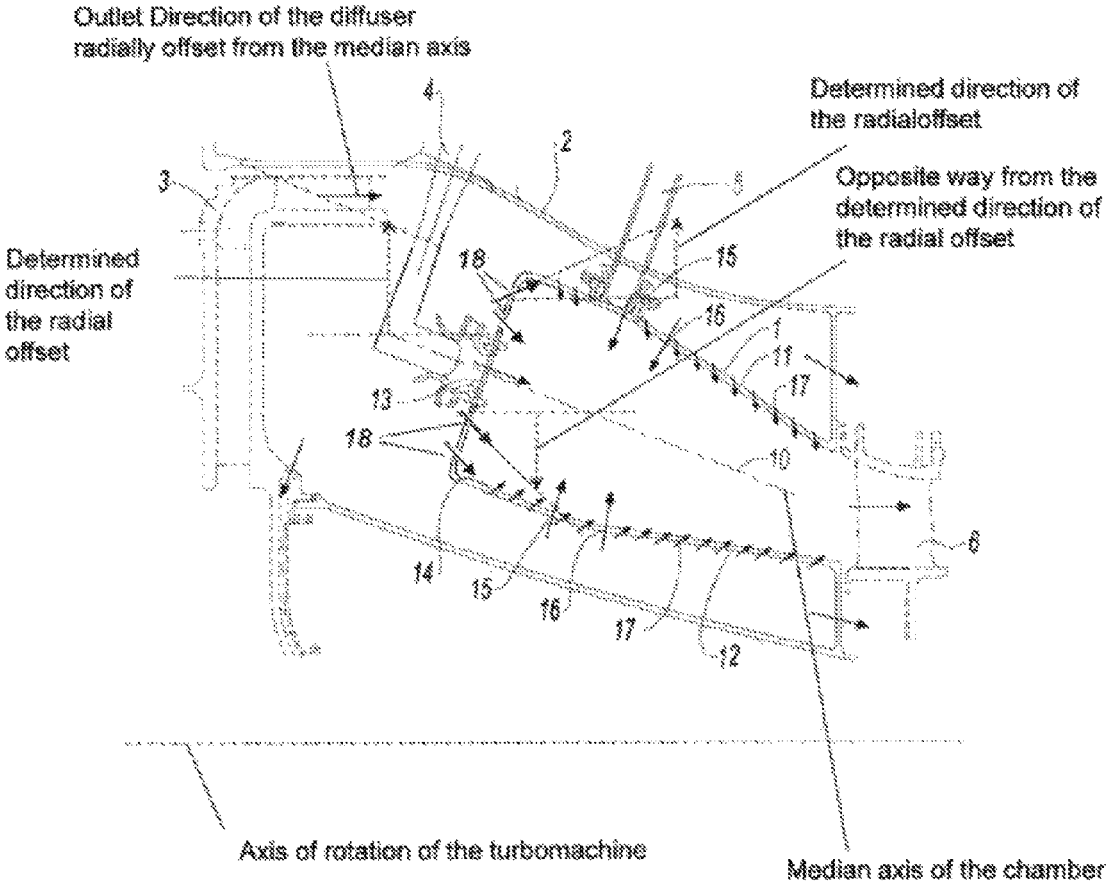
Fig. 1 Background Art
FIG. 1 is a view in cross section of the combustion chamber of a turbomachine, situated downstream of a centrifugal compressor.

Reference is made to FIG. 1 which shows the central part of a turbomachine, contained between the last compressor and the turbine module. It mainly comprises a combustion chamber 1 which is contained within an outer case 2 of the engine and is supplied with air by a diffuser 3 positioned at the outlet of the compressor, and with fuel by injectors 4 distributed uniformly about the circumference of the engine. It also, in the conventional way, comprises devices 5 for igniting the air-fuel mixture, there being one or several of these, likewise distributed about the circumference of the combustion chamber 1.

The diffuser 3 depicted is L-shaped, this being the shape generally adopted in the case of centrifugal compressors, and receiving air oriented radially leaving the last impeller wheel of the compressor and straightening it to eject it into the zone surrounding the chamber 1, in a substantially axial direction. The outlet from the diffuser 3 is realized at the wall of the outer case 2, tangentially with respect to this case. The air from the compressor then spreads out in the zone surrounding the combustion chamber 1 then enters the latter to mix with the fuel supplied by the injectors 4. Because of the L-shaped configuration described, the air leaving the diffuser 3 is injected in a direction which is off-centered in relation to the axis 10 of the combustion chamber 1. This combustion chamber is therefore not supplied uniformly around its periphery and there are differences in air flow rate between the outer wall and the inner wall of the chamber. The invention is described here in terms of a centrifugal compressor and an L-shaped straightener but could just as easily be employed on any turbomachine in which the outlet direction of the diffuser 3 is not along the axis 10 of the combustion chamber.

The combustion chamber 1 has an annular shape which in cross section exhibits an outer wall 11 and an inner wall 12, these two walls lying coaxially along the longitudinal axis 10 of the chamber. They are connected at the upstream end by a wall transverse to this longitudinal axis 10 and commonly known as the chamber end wall 13. The chamber end wall 13 is pierced, at its longitudinal axis 10, with an orifice to which is fitted a carbureted air supply system. Such a system, which is supplied with liquid fuel by the injector 4, comprises concentric annular cascades to create swirling air streams that encourage their mixing with the sheet of atomized fuel.

Finally, on leaving the combustion chamber 1, the gases conventionally pass through a turbine nozzle 6 before passing through the blades of the turbine where they give up some of the energy that they have acquired.

FIG. 1 also shows a deflector 14, the chamber 1 in this respect being depicted in a configuration of the prior art.

The air from the centrifugal compressor passes into the diffuser 3 where it is redirected in the axial direction 10 of the engine then splits into several streams which serve either to feed the combustion of fuel in the primary zone of the chamber 1, via the injection systems and primary holes 15, or to cool the walls 11 and 12 thereof and reach the dilution zone, via dilution holes 16 and wall perforations 17, or alternatively still, to cool other parts of the engine situated downstream of the combustion chamber.

Figure 2:
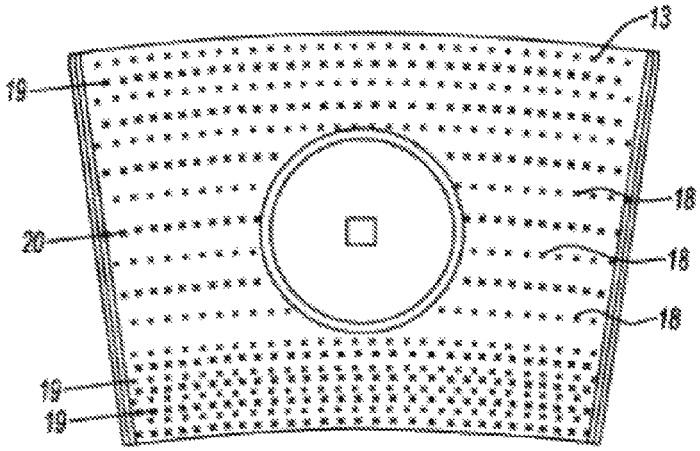
FIG. 2 is a view of a perforated chamber end wall sector according to one embodiment of the invention.

Reference is now made to FIG. 2 which shows one method of cooling for a chamber end wall 13 according to the invention. The chamber end wall 13 is thus perforated with a multitude of small-diameter holes 18 which are arranged in rows 19 running in circles and concentric with the axis 10 of the combustion chamber 1. These holes are typically cylindrical holes the diameter of which is of the order of 0.5 or 0.6 mm and they are oriented in such a way that the cooling stream leaving these perforations 18 remains for as long as possible in contact with the chamber end wall 13 and thus does not alter the richness of the mixture of fuel and air arriving in the primary combustion zone. For that reason, perforations 18 in the chamber end wall are oriented such that their axis at the point in question is at 60° to the normal to the chamber end wall. Unlike in the prior art described in the applicant company's earlier application, the orientation of these perforations does not necessarily change between the rows 19 situated in the region of the injection system and those situated at the extreme, outer and inner, radii of the chamber end wall 13.

By contrast, the invention does claim variability in the density of the perforations 18 (calculated as being the number of holes over a given surface area) between radii situated toward the outer side and those situated toward the inner side of this chamber end wall 13. The hottest parts, i.e. those least exposed to the air from the diffuser 3, are provided with holes in a greater density than those which are relatively well positioned in this air stream. In the scenario depicted in which the diffuser 3 is situated at the outer periphery of the zone surrounding the chamber, the outer parts of the chamber end wall have a perforation density which is lower than that of its inner parts.

Figure 3:
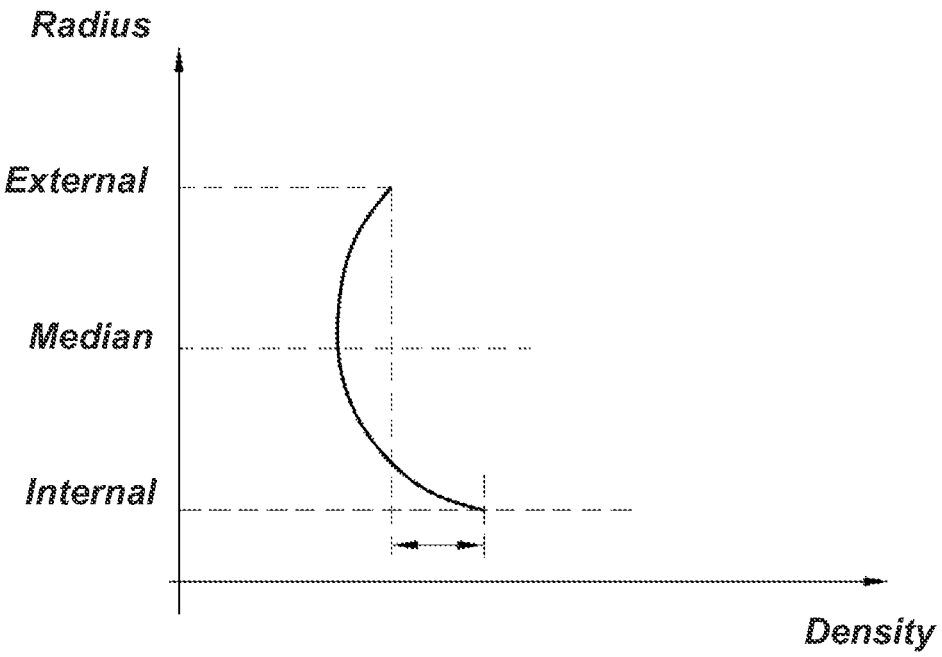
FIG. 3 is diagram showing the density of the perforations in a chamber end wall according to the invention, as based on the radius at which they are located.
Figure 4:
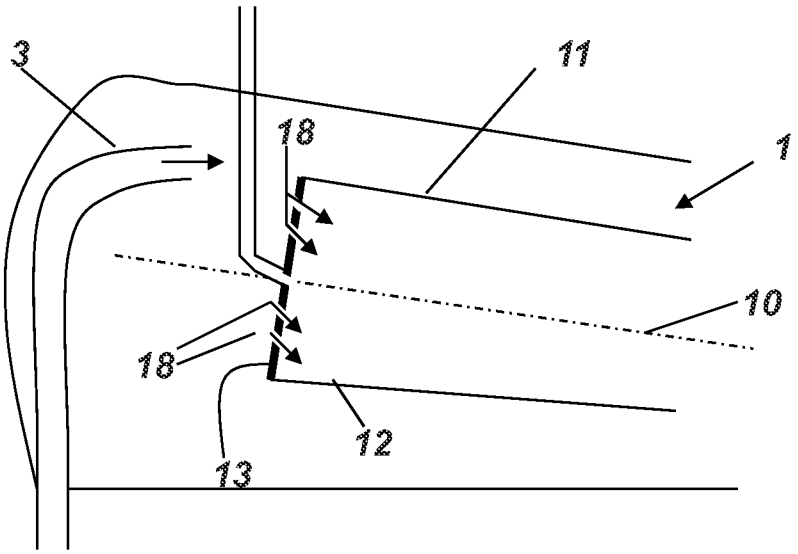
FIG. 4 is a diagrammatic view in cross section of a combustion chamber of a turbomachine according to an embodiment of the invention.

FIG. 3 shows how the density of the perforations 18 evolves across the chamber end wall based on the radial distance of the point in question. It may be noted that the density in the outer part is lower than that in the inner part, which corresponds to the fact that the air from the diffuser 3 spreads unevenly between the upper part and the lower part and that this difference in flow rate has to be compensated for by having a higher perforation 18 density in the lower part. By contrast it may be seen that, in the median row 20, the density is lower than in the outer and inner parts, the reason for this being the better efficiency of cooling of the central rows, which are not disrupted by the moving effect that the film that is in the process of being formed has on the jets impinging on the chamber end wall. There is therefore no need to inject the same flow rate in this row 20 as in the extreme rows which do not themselves enjoy this particular beneficial effect. Correct management of the air from the diffuser, and therefore of the efficiency of the combustion chamber, entails injecting through the perforations 18 only the amount of flow rate that is strictly necessary to obtain a temperature that is consistent with the other points on the end wall 13 of the chamber 1.

The invention also claims a uniform direction for the inclinations of the perforations 18, the air leaving these all being directed, whether these perforations are situated at the outer part or at the inner part, from the outer part toward the inner part so as to provide better cooling of this bottom part of the chamber which is less well supplied with air from the diffuser 3. Bearing in mind the length that the cooling air flow has to travel along the chamber end wall 13, especially in the case of the perforations 18 situated on the outer side, it is absolutely essential that the perforations be inclined steeply, if possible by more than the 60° described in the earlier application. Work which is still ongoing in fact demonstrates the experimental possibility of exceeding this limit of 60°. The maximum possible inclination compatible with technical and economical considerations will therefore be envisaged. The objective of a steep inclination is to cool the metal of the chamber end wall 13 as well as possible and also to ensure that this air does not interfere with the air intended for combustion and does not disrupt the richness of the mixture in the primary combustion zone.

The benefits to be had by this novel technique for cooling the chamber end wall are estimated at a halving of the cooling air flow rate. These benefits can essentially be explained through the reduction in the amount of mass that has to be cooled, which reduction is brought about by dispensing with the deflector. Additional flow rate savings are also had by increasing the permeability of the injection system thanks to the omission of the wall formed by the deflector, and by improving the effectiveness of the cooling of the chamber end wall 13.

The invention has been described in conjunction with a diffuser 3 the outlet axis of which is situated near the outer case 2 of the engine. Quite obviously, the invention can also be employed with a diffuser which ejects air on the side of the inner wall 12 of the combustion chamber 1. In that case, the perforations 18 will be inclined in the direction of the outer wall 11 of the chamber 1 in order to compensate for the fact that this wall is not as well supplied with air from the diffuser.

The invention claimed is:

1. An annular combustion chamber for a turbomachine comprising:

an outer wall and an inner wall which are oriented substantially axially with respect to an axis of rotation of the turbomachine and which is closed at an upstream end by a chamber end wall oriented substantially radially, the annular combustion chamber being supplied with compressed air from a compressor by a diffuser with an outlet having an outlet direction radially offset from a median axis of the annular combustion chamber, the chamber end wall comprising cooling-air supply perforations which are inclined with respect to a direction normal to the chamber end wall, the cooling-air supply perforations being arranged in rows which are circular and concentric with the axis of rotation, wherein the diffuser is radially offset from the median axis in a determined direction, and wherein a density of the cooling-air supply perforations in the chamber end wall increases from a median of the chamber end wall to radially inner and outer peripheries of the chamber end wall in a radial direction, and the density of cooling-air supply perforations at the radially inner periphery of the chamber end wall is greater than the density of cooling-air supply perforations at the radially outer periphery of the chamber end wall.

2. The annular combustion chamber as claimed in claim 1, wherein all the cooling-air supply perforations are oriented radially in a direction away from the outlet direction of the diffuser.

3. The annular combustion chamber as claimed in claim 1, wherein at least one of the cooling-air supply perforations is inclined by an angle greater than or equal to 60° with respect to the direction normal to the chamber end wall in at least part of the chamber end wall.

4. The annular combustion chamber as claimed in claim 3, wherein the part of the chamber end wall is situated radially on a same side as the outlet of the diffuser.

5. The annular combustion chamber as claimed in claim 1, wherein all of the cooling-air supply perforations have a same cross section.

6. The annular combustion chamber as claimed in claim 1, wherein the chamber end wall is exposed directly to thermal radiation of a primary combustion zone.

7. The annular combustion chamber as claimed in claim 1, configured to be installed on the turbomachine with the compressor being a centrifugal compressor and with the diffuser situated on an outer side of the annular combustion chamber, wherein the cooling-air supply perforations are predominantly situated on an inner part of the chamber end wall.

8. A turbomachine comprising an annular combustion chamber as claimed in claim 1.

9. The annular combustion chamber as claimed in claim 1, wherein the annular combustion chamber is free of a deflector.

10. The annular combustion chamber as claimed in claim 1, wherein a first number of cooling-air supply perforations with a radial orientation directed in an opposite way from the determined direction is greater than a second number of cooling-air supply perforations with a radial orientation directed in the same way as the determined direction.

11. An annular combustion chamber for a turbomachine comprising:

an outer wall and an inner wall which are oriented substantially axially with respect to an axis of rotation of the turbomachine and which is closed at an upstream end by a chamber end wall oriented substantially radially and perpendicular to the outer wall and the inner wall, the annular combustion chamber being supplied with compressed air from a compressor by a diffuser with an outlet having an outlet direction radially offset from a median axis of the annular combustion chamber, the chamber end wall comprising cooling-air supply perforations which are inclined with respect to a direction normal to the chamber end wall, wherein the diffuser is radially offset from the median axis in a determined direction, wherein a first number of cooling-air supply perforations with a radial orientation directed in an opposite way from the determined direction is greater than a second number of cooling-air supply perforations with a radial orientation directed in the same way as the determined direction, wherein a density of the cooling-air supply perforations increases radially from a median row to a side of the chamber end wall away from the outlet of the diffuser, and wherein the annular combustion chamber is free of a deflector.

* * * * *